US005704470A

United States Patent [19]

Sutherland

[11] Patent Number: 5,704,470

[45] Date of Patent: Jan. 6, 1998

[54] ARTICLE CARRIER WITH FOUR-SIDED TAPER

[75] Inventor: Robert L. Sutherland, Kennesaw, Ga.

[73] Assignee: Riverwood International Corporation, Atlanta, Ga.

[21] Appl. No.: 591,988

[22] Filed: Jan. 26, 1996

[51] Int. Cl.[6] ..... B65D 75/00

[52] U.S. Cl. ..... 206/147; 206/427

[58] Field of Search ..... 206/141, 147, 206/148, 149, 197, 199, 427, 428, 431, 432

[56] References Cited

U.S. PATENT DOCUMENTS

| | | | |
|---|---|---|---|
| 5,246,112 | 9/1993 | Stout et al. | 206/427 |
| 5,427,241 | 6/1995 | Sutherland | 206/141 |
| 5,439,110 | 8/1995 | Regan, II | 206/427 |

*Primary Examiner*—Jacob K. Ackun

[57] ABSTRACT

An enclosed carrier for beverage bottles. The side and end panels taper inwardly near the top panel to provide a tight enclosure for the bottles. The dust flaps are comprised of upper and lower sections separated from each other in the corner areas of the carrier. The upper dust flap sections may be connected at a point spaced from the separated portions by a strap. Fold lines connecting the strap to the upper dust flap section allow it to be folded about an intermediate fold line in the final carrier package. The top panel may be comprised of two plies, the lower ply including end glue flaps adhered to upper end panel flaps. This eliminates an edge which may tend to snag the tops of bottles being loaded. A working score line is provided in one of the side panels to permit the blank to be folded into a flat collapsed carrier despite the fact that the top panel is narrower than the bottom panel.

14 Claims, 5 Drawing Sheets

ARTICLE CARRIER WITH FOUR-SIDED TAPER

FIELD OF THE INVENTION

This invention relates to a sleeve-type carrier for packaging articles such as beverage bottles. More particularly, it relates to a sleeve-type carrier in which both the side and end panels are tapered.

BACKGROUND OF THE INVENTION

Sleeve-type carriers conventionally are manufactured from an elongated blank having a side panel section at one end and either the bottom panel section or the top panel section at the other end. The blank is formed into a flattened tube by folding the end sections in and adhering them to each other by a glue flap on one of the end sections. This flattened tube, or collapsed carrier as it is often called, is then shipped to a packaging plant where it is erected into tube shape, filled with the articles being packaged and closed at its ends. The end panels of the carrier typically are formed from end flaps, connected to the top and bottom panels, adhered to dust flaps folded in from the side panels.

When bottles are packaged in a sleeve-type carrier the upper portions of the end panels are often made to taper inwardly toward the top panel to more closely conform to the shape of the bottles. To accommodate this shape the dust flaps are formed as separate upper and lower segments or are provided with a fold line to permit inward folding of the dust flaps from a point adjacent the shoulder of the end bottles.

A more difficult design problem is created when the side panels are also tapered toward the top panel. Because the upper portions of the dust flaps are connected to the angled side panel portions, the dust flaps tend to crinkle or bunch up when folded to their final position. Various types of connections have been employed, but none has been found to fold easily into place while allowing the carrier to present a smooth visual transition from the side to the end panels.

It would be highly desirable to provide a tapered carrier which presents a smooth outward appearance, is capable of tightly holding packaged bottles in place and which can be readily and rapidly formed in a packaging machine. It is therefore an object of the invention to provide a carrier which meets these criteria.

BRIEF SUMMARY OF THE INVENTION

The upper portions of the side and end panels of the carrier of the invention are inwardly tapered to provide a tight package for beverage bottles or other tapered articles. Preferably, the carrier has either curved or beveled corners to permit a tight fit at the corner areas of the package. The end panels are comprised of upper and lower end panel flaps adhered to upper and lower dust flap sections. Each upper dust flap section is connected by a fold line to the tapered portion of an associated side panel and has a lower edge adjacent to but separate from the upper edge of the associated lower dust flap section. Both edges extend from the associated side panel. This arrangement allows the upper dust flap sections to lie in the tapered end panel portion. Because the lower edge of each upper dust flap section is preferably downwardly angled relative to the upper edge of an associated lower dust flap section, with at least a portion of the lower edge situated behind the associated lower dust flap section, the carrier corner areas provide a substantially smooth continuous appearance at the juncture between the upper and lower dust flap sections.

In one embodiment of the invention each upper dust flap section includes a strap portion spaced from the lower edge of the section. The strap portion provides a positive connection to the lower dust flap section while allowing the upper dust flap section to be angled as described.

In another aspect of the invention the top panel is comprised of upper and lower plies, with the lower ply including end glue flaps adhered to the underside of the upper end panel flaps. This facilitates the introduction of bottles into the carrier by eliminating a potential snag, as explained below.

The blank used to form the carrier may be provided with a working score line in one of the side panel sections to enable the blank to be folded into flat collapsed carrier form prior to being erected.

These and other features and aspects of the invention will be readily ascertained from the detailed description of the preferred embodiments described below.

DETAILED DESCRIPTION OF THE PREFERRED EMBODIMENTS

Figure 1:
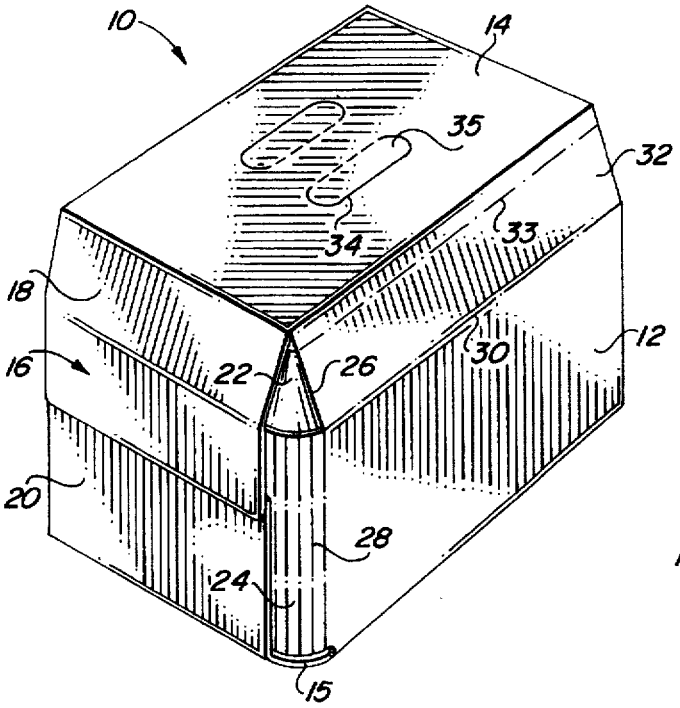
FIG. 1 is a pictorial view of a fully enclosed sleeve-type carrier incorporating the invention.

Referring to FIG. 1, the carrier 10 is a sleeve-type carrier designed to carry twelve beverage bottles arranged in three abutting rows of four bottles each. It is comprised of opposite side panels 12 which are foldably connected to top panel 14 and to a bottom panel the curved edges 15 of which are visible in this view. The carrier also includes end panels 16 formed by upper and lower end panel flaps 18 and 20 which are adhered to each other as well as to upper and lower dust flap sections 22 and 24. The upper dust flap sections 22 are connected to the side panels by angled fold line 26, while the lower dust flap sections 24 are an extension of the side panels. A series of spaced vertical score lines 28 extends from the side panels into the lower dust flap sections, allowing the lower dust flap sections to curve tightly about the body of the adjacent corner bottles in the package. The relationship between the upper and lower dust flap sections is such that they present a smooth, tight, substantially continuous corner structure, which is the appearance desired. This relationship is obtained in the manner explained more fully below.

Score lines 30 in the side panels essentially are adjacent the shoulders of the bottles in the adjacent row of bottles, allowing the side panels to flex inwardly to form the upper tapered portion 32 of the side panels. A working score line 33 is also present in the upper tapered portion 32 for a purpose explained below. Handle openings 34 in the top panel, which may be covered by flaps 35, provide a handle for lifting the carrier. The bottom panel necessarily is longer and wider than the top panel to permit the tapered formation of the side and end panels and to enable the wider body portions of the bottles to snugly fit in the lower rectangular portion of the carrier.

Figure 2:
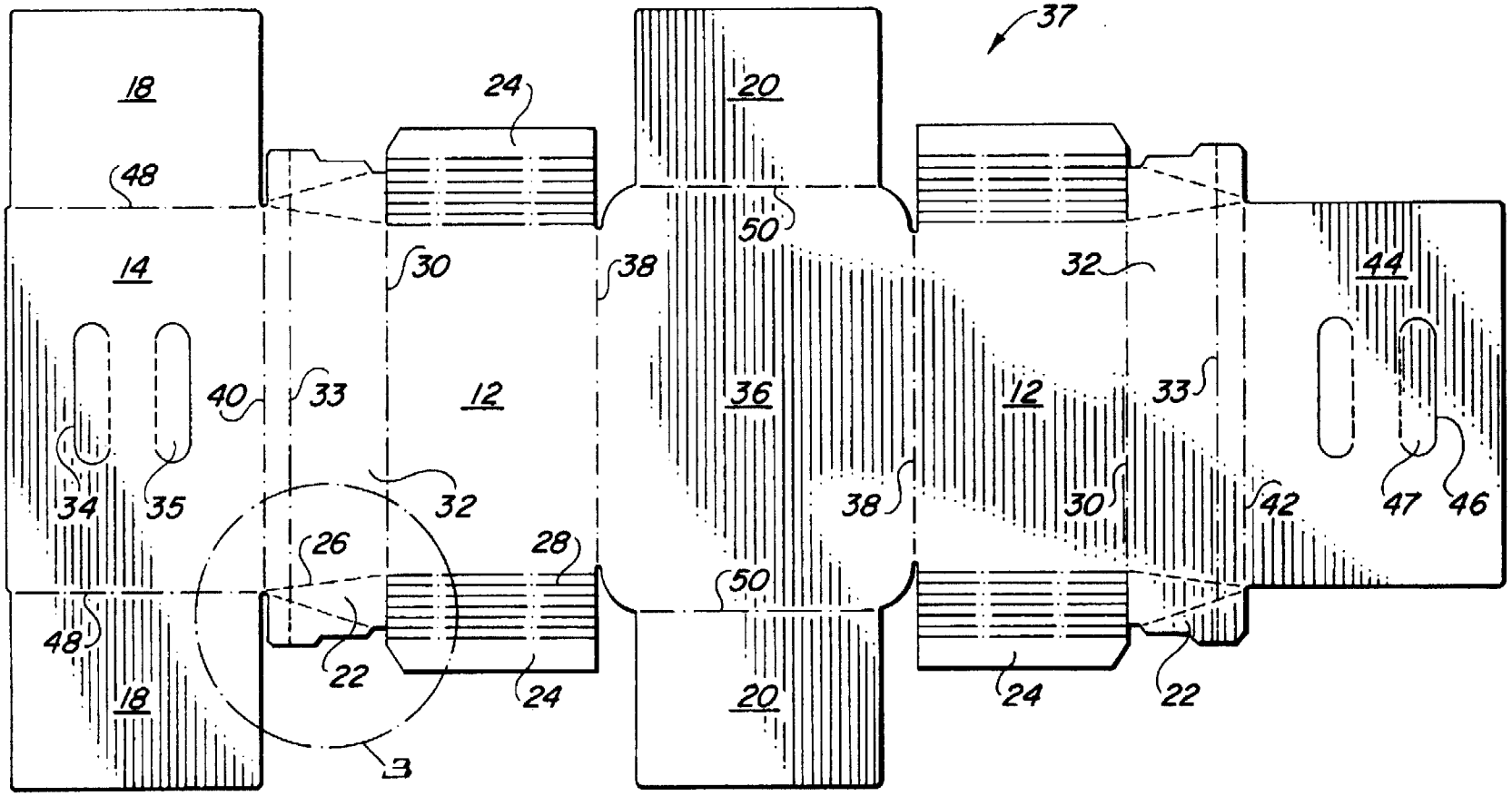
FIG. 2 is a plan view of a blank for forming the carrier of FIG. 1.

Referring to FIG. 2, wherein like reference numerals to those used in FIG. 1 represent similar elements, a blank 37 from which the carrier is formed is comprised of a centrally located bottom panel section 36 connected at opposite sides by fold lines 38 to side panel sections 12. The side panel section to the left of the bottom panel section is connected by fold line 40 to top panel section 14, while the other side panel section is connected by fold line 42 to top panel reinforcement flap 44. The top panel reinforcement flap includes handle openings 46 similar to the handle openings 34 in top panel section 14. As in the case of the top panel section 14, the handle openings may be covered by flaps 47 if desired. Connected to the ends of the top panel section 14 by fold lines 48 are the upper end panel flaps 18. Fold lines 50 connect the lower end panel flaps 20 to opposite ends of the bottom panel section 36.

Figure 3:
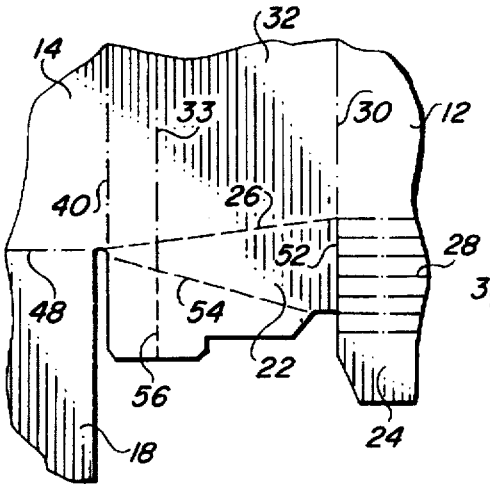
FIG. 3 is an enlarged plan view of the portion of the blank within the circle 3 in FIG. 2.

As best shown in FIG. 3, upper dust flap sections 22 are slightly spaced from the adjacent upper end panel flaps 18 and are separated from the lower dust flap 24 by a slit 52. The fold lines 26 which connect the upper dust flap sections 22 to the upper side panel portions 32 are inwardly angled from the ends of the fold line 40 to a point on the associated score line 30. Outwardly angled fold lines 54 extend from a point adjacent the end of the fold lines 26 to the outer edge of the upper dust flap sections 22. The outer edges of the upper dust flaps are recessed in step fashion in order to be able to clear packaging machine elements, not shown in the drawing. The stepped edge formation, however, has no function after the carrier package has been formed. In addition, the score lines 33 continue across the upper dust flap sections 22 as fold line 56.

Figure 4:
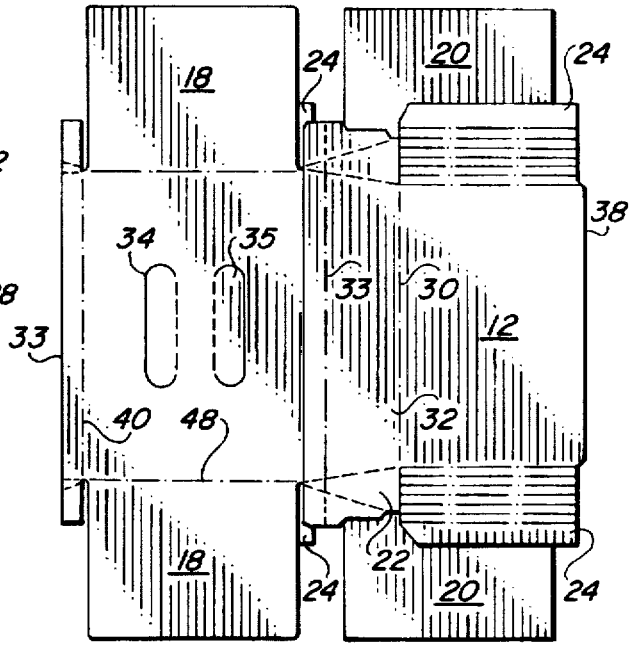
FIG. 4 is a plan view of a collapsed carrier formed from the blank of FIG. 2.

To form a flat collapsed carrier from the blank the portion at the right end of the blank encompassed by the top panel reinforcing flap 44 and the adjacent side panel section 12 are folded in about the associated fold line 38. The top panel section 14 and the portion of the adjacent side panel section between the fold lines 40 and 33 are then pivoted as a unit about the working score line 33 and the aligned fold lines 56 to bring the top panel section 14 into contact with the folded top panel reinforcement flap 44. Glue will have been applied to either of these top panel areas to adhere the top panel section to the top panel reinforcement flap. The resulting collapsed carrier is shown in FIG. 4 to be flattened, suitable for shipment to a packaging plant.

The collapsed carrier is erected by applying inward pressure to the end folds 33 and 38, as is well known in the industry. The erected open-ended carrier at this point is not completely square because the false score 33 is still operative. However, since the combined width of the three rows of bottles is equal to the distance between the lower portions of the side panels, the bottles themselves, as they are inserted into the erected carrier through one or both open ends, force the side panels into proper final position, causing the top panel to square up and fold about the fold line 40. The working score 33 is thus caused to unfold, and the upper portion 32 of the side panel which contains the working score assumes a tapered but essentially planar configuration. The score 33 on the opposite side panel will never have been folded and the side panel upper portion in which it is located remains tapered and essentially planar. This opposite score line is present primarily for the purpose of making the package visually symmetrical, and could be eliminated if desired.

Figure 6:
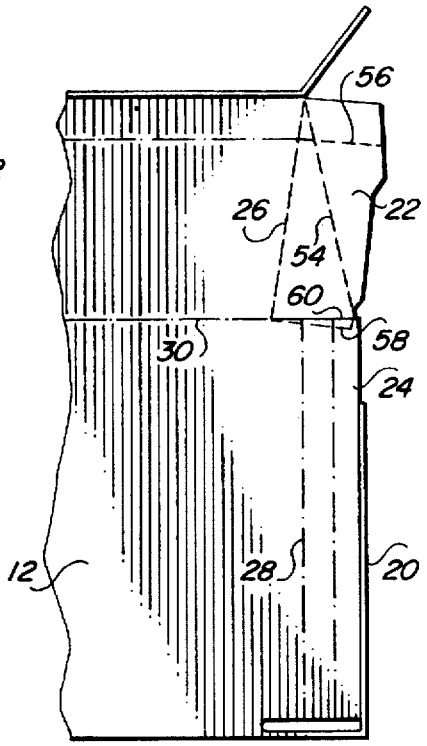
FIG. 6 is a partial side view of the carrier at the stage of formation shown in FIG. 5.
Figure 5:
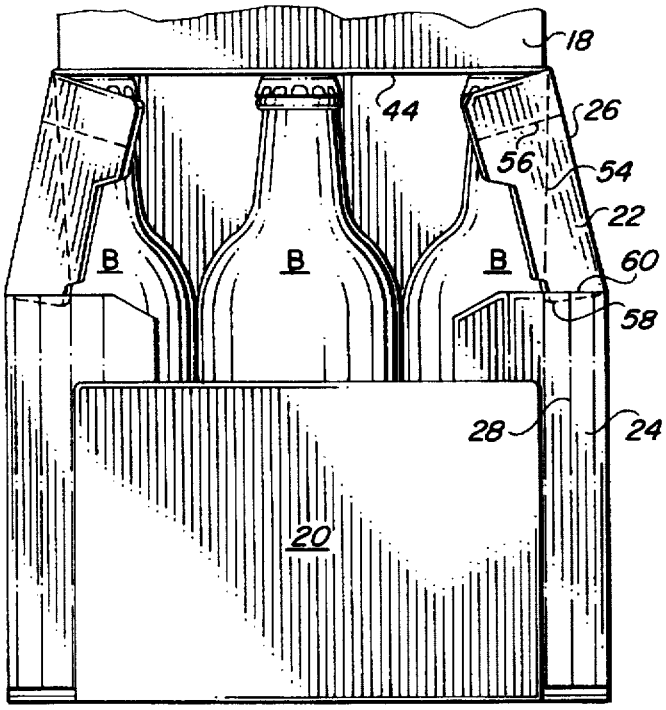
FIG. 5 is an end view of the carrier shown at an interim stage of end panel formation.

To close in the ends of the carrier, the dust flap sections at each end are folded in and the lower end panels 20 are glued to the lower dust flap sections 24. The carrier at this stage is illustrated in FIGS. 5 and 6. The lower dust flap sections 24 are not folded hard about any of the score lines 28, but instead follow the curved contour of the body portion of the adjacent corner bottle. The series of score lines 28 facilitates this smooth curving arrangement. The folding of the dust flap sections will have caused the upper dust flap sections 22 to partially fold in about the fold lines 26. Because the fold lines 26 are downwardly angled with respect to the score lines 28 of the lower dust flap sections 24, the lower portion of the upper dust flap sections 22 is caused to drop in behind the upper portion of the lower dust flap sections 24. This relationship is illustrated in FIGS. 5 and 6 by the dotted lines showing the lower edge 58 of the upper dust flap sections 22 situated behind, and at an angle to, the upper edge 60 of the lower dust flap sections 24. These edges originally were adjacent each other in the carrier blank, having been formed by the slits 52 in the blank. To complete the end panel formation the upper end panel flaps 18 are folded down and glued to overlapping portions of the lower end panel flaps 20 and the upper and lower dust flap sections 22 and 24 to form the configuration shown in FIG. 1. During this process the upper end panel flaps 18 push the end portions of the upper dust flap sections 22 in toward the neck of the end bottles, folding them in about the intermediate fold lines 54.

The resulting carrier is extraordinarily smooth and tight throughout the package. The lower dust flap sections 24 and the lower end panel flaps 20 are in contact with the body portions of adjacent bottles, while the upper dust flap sections 22 and upper end panel flaps 18 are in contact with the shoulders and top portions of adjacent bottles. Note that the fold lines 56 in the upper dust flap sections are not functional in the package but are present to allow the blank to be folded into a collapsed carrier as described above. The disposition of the lower portions of the upper dust flap sections behind the upper portions of the lower dust flap sections creates a smooth break between the two dust flaps at the critical area of the bottle shoulders while leaving no gaps in the carrier surface. As a result the surface of the carrier appears to be unbroken, adding to the quality appearance of the package. Although the carrier may be comprised of any suitable flexible material having sufficient strength to withstand the stresses of carrier formation and the rigors to which the finished carriers are subjected in subsequent handling, it is preferred that it be formed from paperboard of the type conventionally employed in the carrier industry.

The two-ply construction of the top panel adds considerable strength to this critical area of the carrier, at the same time strengthening the handle area. It will be understood, however, that in this embodiment the top panel reinforcement flap could be replaced by a simple short glue flap if it is desired to reduce the amount of material required by the blank while still retaining the other functional aspects of the carrier.

Figure 7:
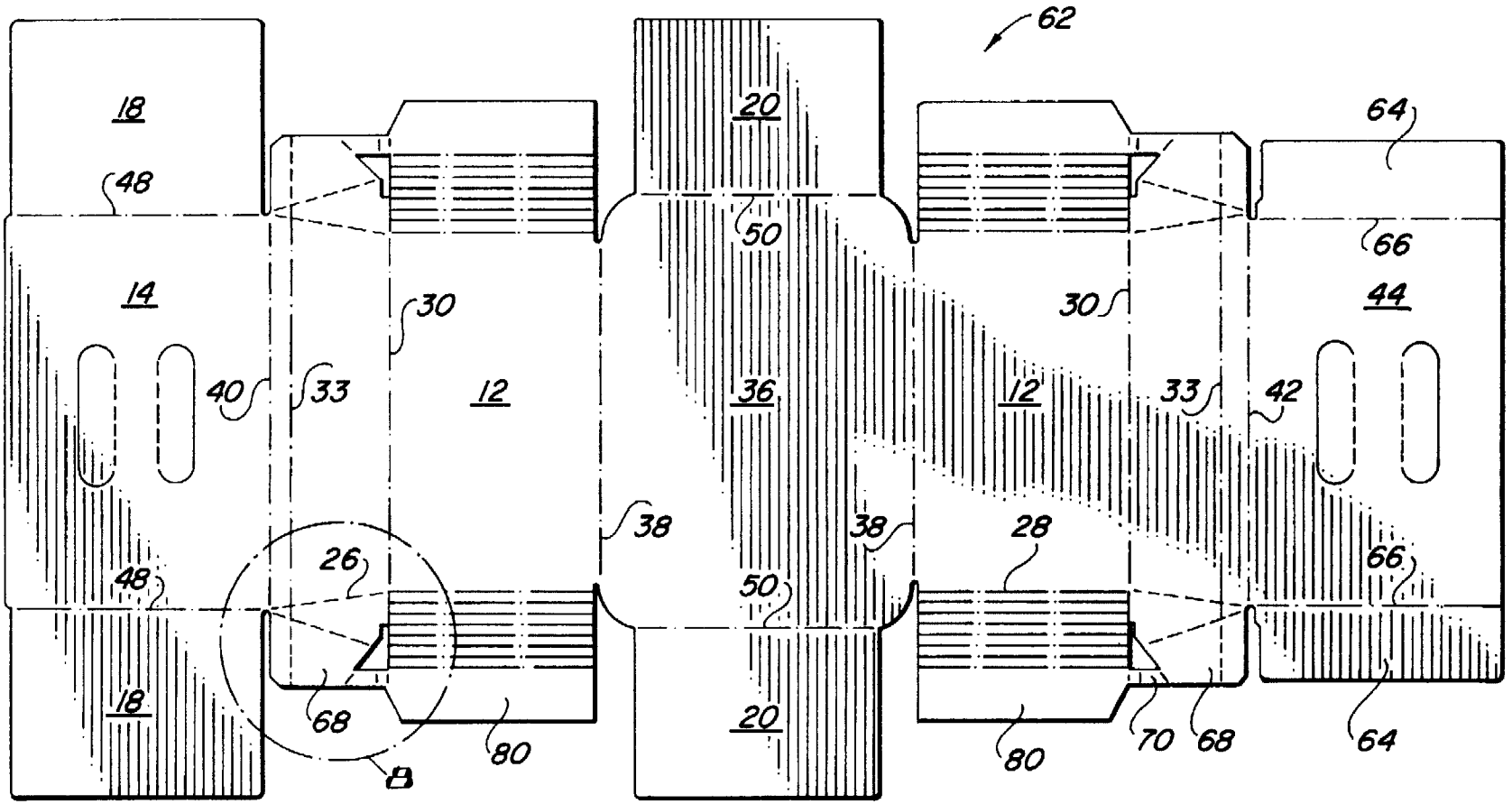
FIG. 7 is a plan view of a blank for forming another embodiment of the carrier of the invention.

Another blank for forming a package with the same appearance as the package of FIG. 1 is shown in FIG. 7, wherein similar elements to those in the first embodiment are denoted by similar reference numerals. The blank 62 is similar to the blank 37 of FIG. 2 except in two areas, the top panel reinforcement flap and the upper dust flap sections. In this embodiment glue flaps 64 are connected by fold lines 66 to the opposite ends of the top panel reinforcement flap 44. Also, the upper dust flap sections 68 are not entirely separate from the lower dust flaps 80 but are connected by a narrow strap portion 70.

Figure 8:
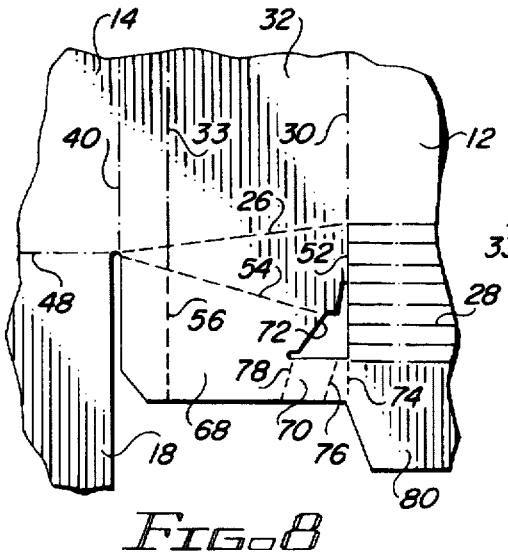
FIG. 8 is an enlarged plan view of the portion of the blank of FIG. 7 within the circle 8.

As best shown in FIG. 8, the upper dust flap sections 68 are connected to the upper portion 32 of the side panel sections 12 by fold line 26 as in the first embodiment. The interior diagonal fold line 54 is also substantially the same as interior fold line 54 in the first embodiment. The upper dust flap sections 68 are wider, however, and include cutout 72, which forms the strap portion 70. The strap portion is connected to the lower dust flap section 80 by fold line 74 and further includes fold line 76, which is spaced from and angled somewhat to fold line 74, and fold line 78, which is spaced from and angled somewhat to fold line 76. Both fold lines 76 and 78 extend from the cutout 72 to the edge of the upper dust flap section 68. Although the lower dust flap sections 80 are essentially the same as the lower dust flap sections 24 of the first embodiment, they too are somewhat wider to accommodate their connection to the strap portion 70. The portion of the upper dust flap sections between the cutout 72 and the fold line 26 is separated from the lower dust flap 80 by slit 52, similar to the slit 52 in the first embodiment.

Figure 9:
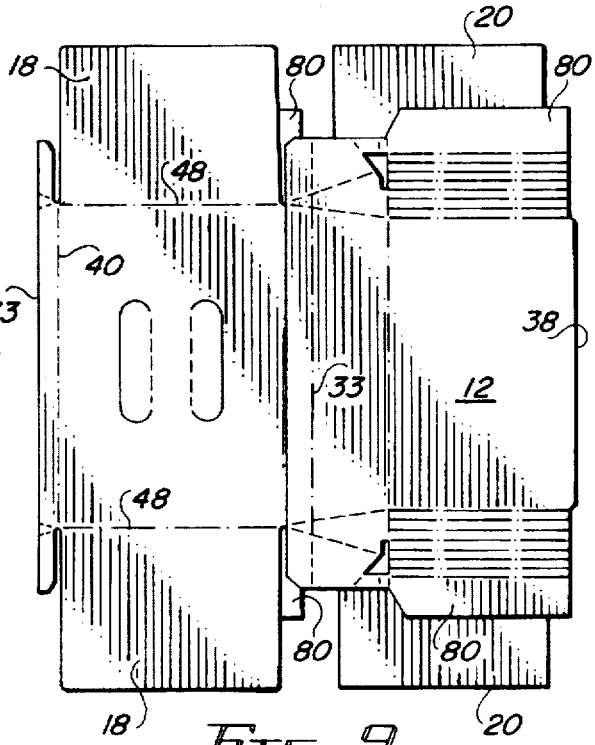
FIG. 9 is a plan view of a collapsed carrier formed from the blank of FIG. 7.
Figure 10:
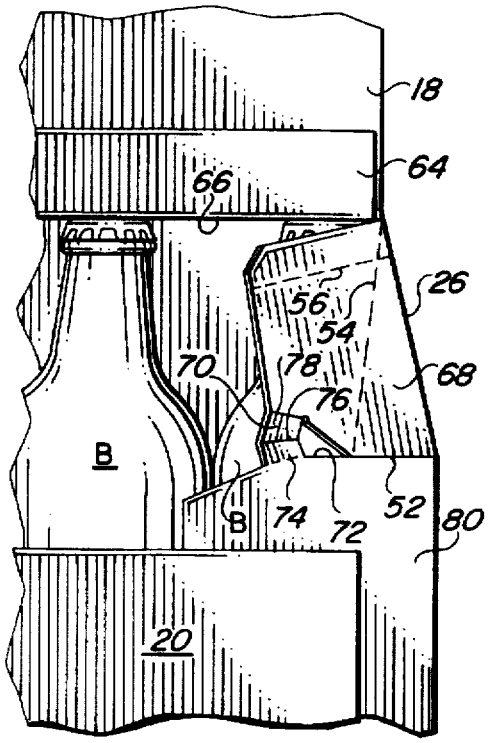
FIG. 10 is a partial end view of a carrier formed from the blank of FIG. 7 shown at an interim stage of formation.

A collapsed carrier, shown in FIG. 9, is formed in the same way as in the first embodiment except that the glue flaps 64 of the top panel reinforcement flap 44 are glued to the upper end panel flaps 18. The collapsed carrier is opened and filled with the bottles being packaged as explained above, then the dust flap sections are folded in and the lower end panel flaps 20 are folded up and glued to the lower dust flap sections 80. The resulting partially formed carrier is illustrated in FIG. 10. Note that when bottles are inserted through an open carrier end the top surfaces of the bottle caps slide past the fold 66 of the glue flap 64. This is in contrast to the first embodiment wherein the top surfaces of the bottle caps must slide past the end edge of the top panel reinforcement flap 44. FIG. 10 may be compared with FIG. 5 to better visualize this difference. The bottles are therefore less likely to snag as they move into the erected carrier of the second embodiment.

Figure 11:
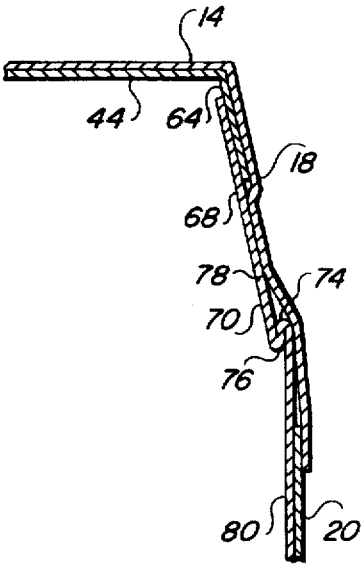
FIG. 11 is a partial longitudinal sectional view of a carrier formed from the blank of FIG. 7, shown with the bottles removed for the purpose of clarity.

Still referring to FIG. 10, the upper dust flap sections 68 are shown in partially closed position as a result of being moved by the lower dust flaps 80. As in the first embodiment, the flaps 68 are folded along downwardly angled fold lines 26. Unlike the first embodiment, where the outer ends of the upper dust flap sections are unconnected and free to move down below the adjacent upper edge of the lower dust flap sections, the outer ends of the upper dust flap sections 68 are connected by fold line 74 to the associated lower dust flap section. When the upper dust flap sections 68 are folded about fold line 26, the strap portion 70 must buckle, and does so by folding inwardly about the fold line 76. Subsequent folding of the top panel 14 into place pushes the upper dust flap sections 68 further inward and downward to their final position, causing the strap portion between the fold lines 74 and 76 to pivot down to a position abutting the lower dust flap 80. This final end panel arrangement is illustrated in FIG. 11, which shows the relationship of the various end panel elements to each other. Note that the thickness of the paperboard has been exaggerated in order to better illustrate the various flaps and panels. In actual carriers, however, the slight indentations of the upper end panel flap 18 would be hardly noticeable, and the gap between the upper end panel flap 18 and the strap portion 70 of the upper dust flaps would be negligible. It will be understood that while the edges of the upper and lower dust flap sections formed by the slit 52 are still abutting at the point depicted in FIG. 10, continued folding of the upper dust flap section to its final position in the carrier will cause the unconnected lower edge of the upper dust flap section to slip down behind the unconnected upper edge of the lower dust flap section in the same manner as the corresponding edges of the first embodiment, thus forming a similar corner appearance.

Figure 12:
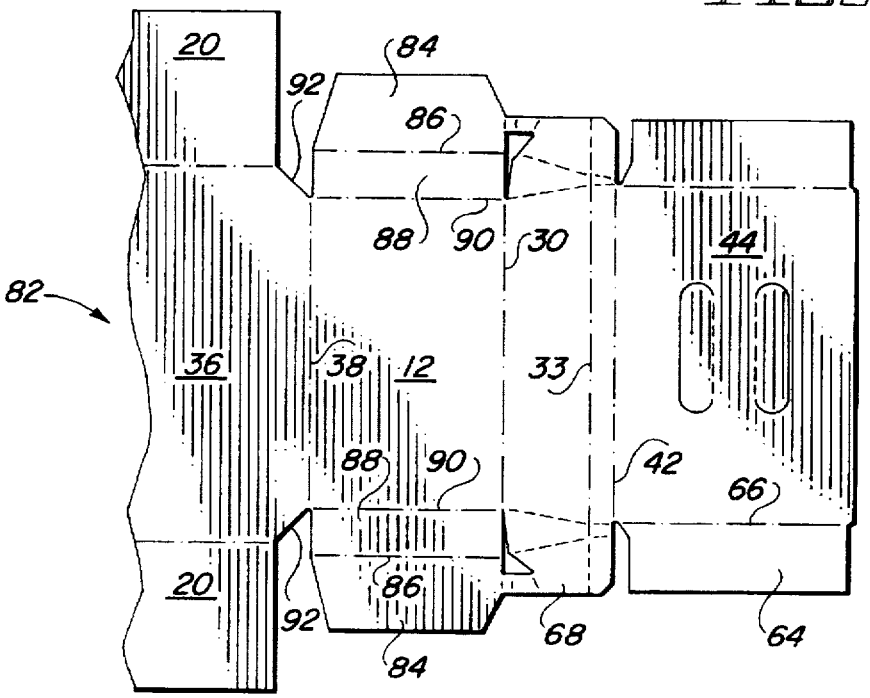
FIG. 12 is a partial plan view of a blank for forming another embodiment of the carrier of the invention.

A portion of a further modified blank 82 is shown in FIG. 12. As in the second embodiment, glue flaps 64 are connected to the top reinforcement flap 44 and upper dust flap sections 68 are provided. However, instead of connecting the lower dust flap sections to the side panels by a series of score lines in order to create curved corners, the lower dust flap sections 84 are connected by fold lines 86 to bevel panels 88. The bevel panels in turn are connected to the side panel sections 12 by fold lines 90. In this construction, the corner areas of the bottom panel section 36 are formed by diagonal edges 92.

Figure 13:
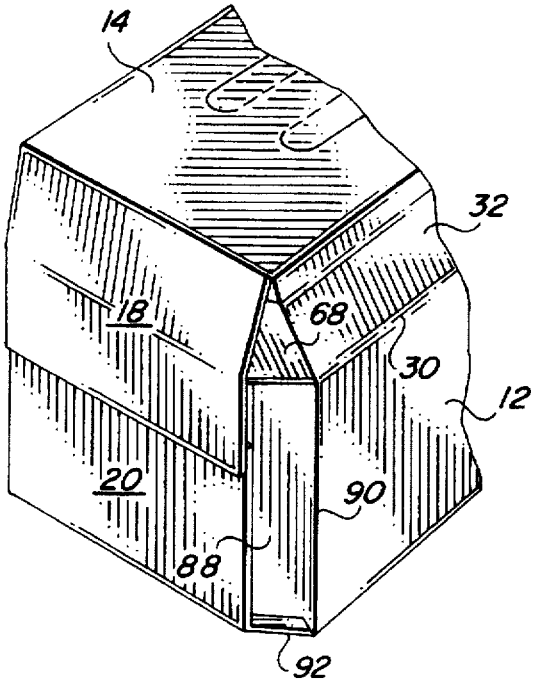
FIG. 13 is a partial pictorial view of a carrier formed from the blank of FIG. 12.

The blank is fabricated into a collapsed carrier and erected as explained in connection with the second embodiment. In this case, however, in the finished carrier illustrated in FIG. 13 the bevel panels 88 at the corner areas of the carrier abut the corner bottles to tightly hold the bottles in place. The diagonal edges 92 of the bottom panel correspond in shape, permitting the bottoms of the adjacent corner bottles to extend out to the end of the bottom panel adjacent the bevel panels. The cutout in the upper dust flap sections 68 may be slightly longer than the cutout in the second embodiment, as shown in FIG. 12, to better allow the upper dust flap sections to move into position behind the upper portions of the adjacent bevel panels. Except for having beveled corners instead of rounded corners, the carrier of FIG. 13 corresponds in all other aspects to the second described embodiment of the invention.

Although not shown, the top panel may be provided with stress relief score lines extending from the handle openings to the corners of the carrier in order to distribute lifting stresses to the stronger corner areas of the carrier. The same may be done with the top panel reinforcement flap to further strengthen the package.

It will now be appreciated that the invention provides a carrier that fits tightly about both the body and neck portions of packaged beverage bottles, with the upper dust flap sections automatically moving into correct position as the end panels are formed. Although the carrier of the invention has been described in connection with a sleeve-type carrier adapted to package twelve bottles, it will be understood that it may be modified to package other types of tapered articles as well as other numbers of articles. It should further be understood that the invention is not limited to all the specific details described in connection with the preferred embodiment, except as they may be within the scope of the appended claims, and that changes to certain features of the preferred embodiments which do not alter the overall basic function and concept of the invention are contemplated.

What is claimed is:

1. An article carrier, comprising:

opposite side panels connected by fold lines to a top panel and a bottom panel, the bottom panel being longer and wider than the top panel;

opposite end panels including dust flaps connected to opposite ends of the side panels, upper end panel flaps connected to opposite ends of the top panel and lower end panel flaps connected to opposite ends of the bottom panel, each end panel being comprised of an upper end panel flap and a lower end panel flap adhered to opposite folded dust flaps;

the side panels and the end panels having inwardly tapered upper portions extending to the top panel;

each dust flap being comprised of upper and lower sections, the upper dust flap section being connected by a fold line to the tapered portion of an associated side panel, said fold line having a lower end; and each upper dust flap section having a lower edge extending from a point on an associated side panel substantially at the lower end of said fold line and each lower dust flap section having an upper edge extending from substantially said point on said associated side panel;

the lower edge of the upper dust flap section being adjacent to but separate from the upper edge of an associated lower dust flap section, and the lower edge of each upper dust flap section being downwardly angled relative to the upper edge of an associated lower dust flap section, with at least a portion of said lower edge being situated behind the associated lower dust flap section.

2. An article carrier as defined in claim 1, wherein the inwardly tapered portion of each side panel is connected to the side panel by a score line extending substantially parallel to the fold lines connecting the top panel to the side panels, said point on each side panel lying substantially on said score line.

3. An article carrier as defined in claim 1, wherein each upper dust flap section includes an angled intermediate fold line extending downwardly from a point adjacent the fold line connecting the upper dust flap section to the tapered portion of an associated side panel to a point spaced from said connecting fold line.

4. An article carrier as defined in claim 1, wherein each upper dust flap section includes a strap portion spaced from the lower edge thereof, the strap portion being connected to the lower dust flap section by a first strap fold line, the strap portion of each upper dust flap section being spaced from the lower edge of said upper dust flap section by a cutout.

5. An article carrier as defined in claim 4, wherein the strap portion is connected to the upper dust flap section by a second strap fold line, the strap portion including a third strap fold line intermediate the first and second strap fold lines.

6. An article carrier as defined in claim 5, wherein the strap portion between the first and third strap fold lines is behind and substantially abutting the associated lower dust flap section.

7. An article carrier, comprising:

opposite side panels connected by fold lines to a top panel and a bottom panel;

opposite end panels including upper end panel flaps connected to opposite ends of the top panel and lower end panel flaps connected to opposite ends of the bottom panel;

the top panel being comprised of upper and lower plies; and the lower ply of the top panel including end glue flaps adhered to the upper end panel flaps.

8. A blank for forming an article carrier, comprising:

a bottom panel section connected by fold lines to opposite side panel sections;

one of the side panel sections being connected by a fold line to a glue flap and the opposite side panel section being connected by a fold line to a top panel flap, the bottom panel section being longer and wider than the top panel flap;

upper end panel flaps connected by fold lines to opposite ends of the top panel flap and lower end panel flaps connected by fold lines to opposite ends of the bottom panel section;

dust flaps connected to opposite ends of the side panel sections, each dust flap being comprised of upper and lower sections, each upper dust flap section being connected by an inwardly angled fold line to an associated side panel; and each upper dust flap section having an unconnected edge extending substantially from an associated inwardly angled fold line and each lower dust flap section having an adjacent unconnected edge extending substantially from said downwardly angled fold line.

9. A blank as defined in claim 8, wherein each upper dust flap section includes a strap portion spaced from the unconnected edge thereof, the strap portion being connected to the associated lower dust flap section by a first strap fold line.

10. A blank as defined in claim 9, wherein the strap portion of each upper dust flap section is spaced from the unconnected edge of said section by a cutout.

11. A blank as defined in claim 10, wherein the strap portion is connected to the upper dust flap section by a second strap fold line, the strap portion including a third strap fold line intermediate the first and second strap fold lines.

12. A blank for forming an article carrier, comprising:

a bottom panel section connected by fold lines to opposite side panel sections;

one of the side panel sections being connected by fold line to a top panel flap and the opposite side panel section being connected by fold line to a top panel reinforcing flap of substantially the same width as the width of the top panel flap; and each top panel reinforcing flap including opposite end glue flaps adapted to be adhered to the upper end panel flaps in a carrier formed from the blank.

13. An article carrier, comprising:

opposite side panels connected by fold lines to a top panel and a bottom panel, the bottom panel being longer and wider than the top panel;

opposite end panels including dust flaps connected to opposite ends of the side panels, upper end panel flaps connected to opposite ends of the top panel and lower end panel flaps connected to opposite ends of the bottom panel, each end panel being comprised of an upper end panel flap and a lower end panel flap adhered to opposite folded dust flaps;

the side panels and the end panels having inwardly tapered upper portions extending to the top panel;

each dust flap being comprised of upper and lower sections, the upper dust flap section being connected by a fold line to the tapered portion of an associated side panel, said fold line having a lower end;

each upper dust flap section having a lower edge extending from a point on an associated side panel substantially at the lower end of said fold line and each lower dust flap section having an upper edge extending from substantially said point on said associated side panel;

the lower edge of the upper dust flap section being adjacent to but separate from the upper edge of an associated lower dust flap section; and the top panel being comprised of upper and lower plies, the lower ply of the top panel including end glue flaps adhered to the upper end panel flaps.

14. A blank for forming an article carrier, comprising:

a bottom panel section connected by fold lines to opposite side panel sections;

one of the side panel sections being connected by a fold line to a glue flap and the opposite side panel section being connected by a fold line to a top panel flap, the bottom panel section being longer and wider than the top panel flap;

upper end panel flaps connected by fold lines to opposite ends of the top panel flap and lower end panel flaps connected by fold lines to opposite ends of the bottom panel section;

dust flaps connected to opposite ends of the side panel sections, each dust flap being comprised of upper and lower sections, each upper dust flap section being connected by an inwardly angled fold line to an associated side panel; and each upper dust flap section having an unconnected edge extending substantially from an associated inwardly angled fold line and each lower dust flap section having an adjacent unconnected edge extending substantially from said downwardly angled fold line;

the glue flap connected to one of the side panel sections being a top panel reinforcing flap having a width substantially as great as the width of the top panel section, each top panel reinforcing flap including opposite end glue flaps adapted to be adhered to the upper end panel flaps in a carrier formed from the blank.

* * * * *